US012161178B2

(12) United States Patent
Choi

(10) Patent No.: US 12,161,178 B2
(45) Date of Patent: Dec. 10, 2024

(54) GLOVE FOR LEISURE

(71) Applicant: Yong Ho Choi, Namyangju-si (KR)

(72) Inventor: Yong Ho Choi, Namyangju-si (KR)

( * ) Notice: Subject to any disclaimer, the term of this patent is extended or adjusted under 35 U.S.C. 154(b) by 217 days.

(21) Appl. No.: 17/758,364

(22) PCT Filed: Sep. 1, 2020

(86) PCT No.: PCT/KR2020/011719
§ 371 (c)(1),
(2) Date: Jul. 5, 2022

(87) PCT Pub. No.: WO2021/137383
PCT Pub. Date: Jul. 8, 2021

(65) Prior Publication Data

US 2023/0140755 A1 May 4, 2023

(30) Foreign Application Priority Data

Jan. 2, 2020 (KR) ..... 10-2020-0000392

(51) Int. Cl.
*A41D 19/015* (2006.01)
*A63B 71/14* (2006.01)

(52) U.S. Cl.
CPC ..... *A41D 19/01547* (2013.01); *A63B 71/146* (2013.01); *A41D 2400/80* (2013.01); *A41D 2600/10* (2013.01)

(58) Field of Classification Search
CPC ..... A41D 19/01547; A41D 19/01576; A41D 19/01558; A41D 2400/80; A41D 19/00; A63B 71/146
See application file for complete search history.

(56) References Cited

U.S. PATENT DOCUMENTS 1,346,683 A * 7/1920 Reynolds ..... A41D 19/0065 2/164
2,459,985 A * 1/1949 Woodbury ..... A41D 19/01558 2/167

(Continued)

FOREIGN PATENT DOCUMENTS

KR 20-1995-0013416 U 6/1995
KR 20-1995-0026769 U 10/1995

(Continued)

OTHER PUBLICATIONS

English Translation of the International Search Report (ISR), Application PCT/KR2020/011719, completed Dec. 31, 2020, mailed Jan. 4, 2021, 2 pages.

*Primary Examiner* — Heather Mangine
(74) *Attorney, Agent, or Firm* — Ware, Fressola, Maguire & Barber LLP

(57) ABSTRACT

The present invention relates to a leisure glove that is capable of having grip reinforcing members adapted to allow radial portions formed radially from central portions thereof and stripe-shaped wave portions surrounding the central portions to be spaced apart from one another, respectively, so that a contact force with a golf club can be strengthened to improve a grip force. According to the present invention, the leisure glove includes: a body; and grip reinforcing members formed on the outer surface of the palm portion of the body, wherein the grip reinforcing members may include: central portions; radial portions protruding from the center of each central portion in every direction; and wave portions formed to the shapes of stripes surrounding each central portion and spaced apart from one another to gradually expand outwardly.

7 Claims, 2 Drawing Sheets

(56) References Cited

U.S. PATENT DOCUMENTS 5,117,509 A * 6/1992 Bowers ..... A63B 71/148 2/161.1
5,251,335 A * 10/1993 DeFusco ..... A63B 71/146 2/163
5,504,942 A * 4/1996 Kuwahara ..... A41D 27/208 2/163
5,511,248 A * 4/1996 Widdemer ..... A63B 71/146 2/163
5,708,979 A * 1/1998 Redwood ..... A41D 19/01582 2/167
6,044,494 A * 4/2000 Kang ..... A41D 19/01558 2/161.3
6,081,928 A * 7/2000 Bourne ..... A41D 19/0055 2/163
6,098,199 A * 8/2000 Barkin ..... A63B 60/08 74/551.8
6,154,885 A * 12/2000 Kobayashi ..... A63B 71/146 2/161.3
6,212,687 B1 * 4/2001 Kwon ..... A41D 19/01547 2/161.3
6,513,166 B1 * 2/2003 Landis ..... A41D 19/01547 2/205
D536,510 S * 2/2007 Schuller ..... D2/617
D549,927 S * 9/2007 Schuller ..... D2/617
7,703,179 B2 * 4/2010 Ferguson ..... A63B 60/14 16/431
8,132,269 B1 * 3/2012 Ibon ..... A63B 71/143 2/161.1
8,863,317 B2 * 10/2014 Tsuru ..... A41D 19/015 2/167
10,993,488 B1 * 5/2021 Chou ..... B32B 9/025
2001/0044950 A1 * 11/2001 Sajovic ..... A41D 19/01547 2/168
2004/0025224 A1 * 2/2004 Albert ..... A41D 19/01558 2/159
2004/0081801 A1 * 4/2004 Albert ..... A63B 71/148 428/343
2005/0058794 A1 * 3/2005 Fujisawa ..... A63B 41/08 428/143
2005/0160516 A1 * 7/2005 Price ..... A41D 19/01558 2/161.6
2006/0210766 A1 * 9/2006 Press ..... A41D 31/04 427/256
2006/0230493 A1 * 10/2006 Corry ..... A63B 69/3608 2/159
2006/0282936 A1 * 12/2006 Olson ..... A41D 19/01558 2/161.7
2007/0174948 A1 * 8/2007 Robba ..... A63B 71/146 2/161.1
2008/0109934 A1 * 5/2008 Widdemer ..... A41D 19/01523 2/159
2008/0235850 A1 * 10/2008 Cabauy ..... A41D 19/01558 2/168
2009/0139008 A1 * 6/2009 Drab ..... A63B 71/146 2/161.3
2009/0139010 A1 * 6/2009 Bevier ..... A63B 71/148 2/163
2010/0000005 A1 * 1/2010 Dossman ..... A41D 13/0015 2/125
2010/0183814 A1 * 7/2010 Rios ..... A63B 60/00 427/387
2010/0192280 A1 * 8/2010 McClard ..... B44C 1/1712 428/172
2011/0030121 A1 * 2/2011 Smalls ..... A41D 19/01547 2/161.7
2011/0197337 A1 * 8/2011 Lee ..... A63B 71/146 2/163
2012/0288628 A1 * 11/2012 Nethsinghe ..... D06N 3/106 427/277
2013/0117904 A1 * 5/2013 Batista ..... A41D 19/01558 2/161.3
2014/0223635 A1 * 8/2014 Rogers ..... A41D 19/01558 2/161.1
2014/0283289 A1 * 9/2014 Hawkins ..... A41D 13/0002 2/455
2015/0143610 A1 * 5/2015 Pimentel de Oliveira ..... A41D 19/0058 2/167
2015/0189932 A1 * 7/2015 Champagne ..... A61B 42/10 2/161.6
2016/0101342 A1 * 4/2016 Iacono ..... A63B 71/148 2/161.2
2017/0231304 A1 * 8/2017 Provencher ..... G06F 3/0393 2/162
2017/0348065 A1 * 12/2017 Bluecher ..... A41D 19/0003
2018/0242657 A1 * 8/2018 Hawkins ..... A41D 13/0156
2018/0249774 A1 * 9/2018 Ohanian ..... A41D 13/087
2019/0014838 A1 * 1/2019 Price ..... A41D 27/28
2022/0030988 A1 * 2/2022 Furstenburg ..... A41D 19/01558
2023/0140755 A1 * 5/2023 Choi ..... A63B 71/146 2/159

FOREIGN PATENT DOCUMENTS

KR 10-2006-0112337 A 11/2006
KR 20-2009 0003927 U 4/2009
KR 10-1697688 B1 2/2017

* cited by examiner

GLOVE FOR LEISURE

CROSS REFERENCE TO RELATED APPLICATION OF THE INVENTION

The present application claims the benefit of Korean Patent Application No. 10-2020-0000392 filed in the Korean Intellectual Property Office on Jan. 2, 2020, the entire contents of which are incorporated herein by reference.

BACKGROUND OF THE INVENTION

Field of the Invention

The present invention relates to a leisure glove, and more specifically, to a leisure glove that is capable of being worn on a user's hand when he or she plays leisure sports activities such as golf to thus protect his or her hand and improve a grip force when comes into contact with the grip of a golf club.

Background of the Related Art

Generally, a golf glove as a consumable product is made of natural or artificial leather and cut out and then sewn to a hand shape. Further, a Velcro tape is sewn on the wrist portion of the golf glove to protect a wearer's wrist and fix the golf glove to his or her hand, and a band is sewn on the top periphery of the golf glove to prevent the golf glove from slipping down.

After the golf glove has been worn, however, if the wearer grips his or her golf club and swings the golf club, the thumb portion of the golf glove comes into contact with the golf club and becomes thus loose easily, and the loose thumb portion of the golf glove is laid on the wearer's thumb, so that an injury such as a blister may be made on his or her thumb, and further, if the golf glove is worn for long hours, the contact portion of the golf glove with the wearer's thumb may be rolled or torn.

When the wearer grips the golf club, further, the golf glove generates a frictional force against the grip of the golf club, thereby preventing slipping from the golf club and avoiding his or her fingers or palm from being injured due to the frictional force against the grip of the golf club.

To do this, the conventional golf club is made of natural or artificial leather capable of generating a high frictional force and being not damaged well.

However, the natural or artificial leather does not absorb and emit sweat gently, and if the golf glove made of the natural or artificial leather is worn for long hours, accordingly, many inconveniences due to the sweat may be undesirably caused.

SUMMARY OF THE INVENTION

Accordingly, the present invention has been made in view of the above-mentioned problems occurring in the related art, and it is an object of the present invention to provide a leisure glove that is capable of having grip reinforcing members adapted to allow radial portions formed radially from central portions thereof and stripe-shaped wave portions surrounding the central portions to be spaced apart from one another, respectively, so that a contact force with a golf club can be strengthened to improve a grip force, while the absorption and emission of sweat are being easily performed.

To accomplish the above-mentioned objects, according to the present invention, there is provided a leisure glove including: a body; and grip reinforcing members formed on the outer surface of the palm portion of the body, wherein the grip reinforcing members may include: central portions; radial portions protruding from the center of each central portion in every direction; and wave portions formed to the shapes of stripes surrounding each central portion and spaced apart from one another to gradually expand outwardly.

According to the present invention, desirably, the body may be made of a functional fabric, and the grip reinforcing members may be made of silicone.

According to the present invention, desirably, each grip reinforcing member may be formed of a plurality of scale members overlapped with one another.

According to the present invention, desirably, each grip reinforcing member may be formed of a plurality of sucking members concavely formed toward the surface direction of the body.

According to the present invention, desirably, the body may include: a first cover adapted to cover the front and rear surfaces of a wearer's wrist, the back of the wearer's hand, and the rear surfaces of the wearer's fingers; a second cover connected to the first cover to cover the front surface of the wearer's thumb; and a third cover connected to the first cover to cover the front surfaces of the index, middle, ring, and little fingers, and the grip reinforcing members may be located on the second cover and the third cover, respectively.

BRIEF DESCRIPTION OF THE DRAWINGS

The above and other objects, features and advantages of the present invention will be apparent from the following detailed description of the embodiments of the invention in conjunction with the accompanying drawings, in which.

DETAILED DESCRIPTION OF THE EMBODIMENTS

Figure 1:
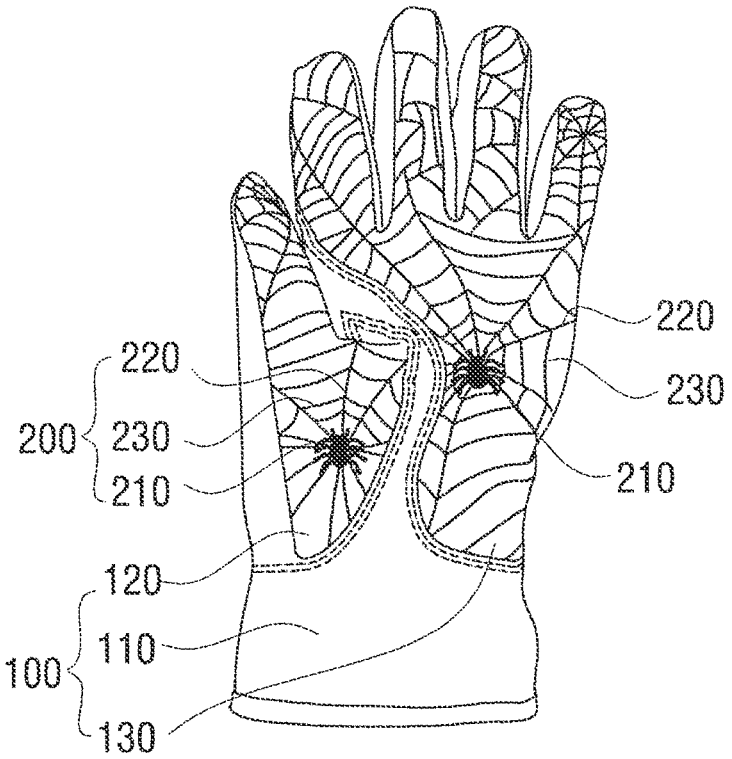
FIG. 1 is a perspective view showing a leisure glove according the present invention.

As shown in FIGS. 1 to 4, a leisure glove according to the present invention includes a body 100 and grip reinforcing members 200.

The body 100 is adapted to surround a wearer's entire hand, in the same manner as a general glove, and made of a functional fabric capable of easily absorbing and emitting sweat.

Of course, the body 100 may be made of various fabrics having high water absorbing forces.

The body 100 includes a first cover 110, a second cover 120, and a third cover 130 according to worn regions thereof.

The first cover 110 is adapted to surround the front and rear surfaces of the wearer's wrist, the back of the wearer's hand, and the rear surfaces of the wearer's fingers.

That is, the first cover 110 is configured to have the lower end periphery adapted to surround the circumference of the wrist and the upper end periphery extending toward the middle finger from the lower end periphery to the third cover and then turning at an obtuse angle into a space above the second cover between the thumb and the index finger to cover the back of the wearer's hand.

The second cover 120 is connected to one side between the lower end periphery and the upper end periphery of the first cover 110 to cover the thumb and the thick region under the thumb, that is, the base region of the thumb.

The third cover 130 is connected to the other side between the lower end periphery and the upper end periphery of the first cover 110 to cover the front surfaces of the index, middle, ring, and little fingers.

Like this, the body 100 is configured to have the second cover 120 for covering the wearer's thumb and the third cover 130 for covering the other fingers of the wearer, which are disposed on both sides of the first cover 110, so that when the wearer grips a golf club, and the like, the interference between the thumb and the other fingers can be reduced to allow the movements of the wearer's hand to be conveniently performed.

Further, the grip reinforcing members 200 are disposed on the second cover 120 and the third cover 130 of the body 100, respectively.

Figure 2:
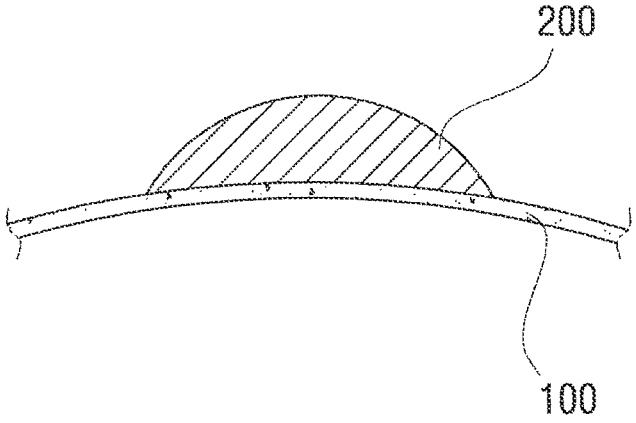
FIG. 2 is a sectional view showing a grip reinforcing member of the leisure glove according to the present invention.

As shown in FIGS. 1 and 2, the grip reinforcing members 200 are coated onto the outer surface of the palm of the body 100 and made of silicone having a high contact force.

Further, each grip reinforcing member 200 includes a central portion 210, radial portions 220, and wave portions 230.

The central portions 210 have the shape of a spider and are formed on the second cover 120 and the third cover 130, respectively.

In specific, one central portion 210 is formed on the bottom region of the thumb, that is, the base region of the thumb on the second cover 120, and the other central portion 210 is formed on the palm below the ring finger portion on the third cover 130.

The central portions 210 are located on the portions where the contact areas with the golf club are largest when the wearer grips the golf club, respectively, thereby improving a grip force and preventing slipping from the golf club.

The radial portions 220 protrude from the center of each central portion 210 in every direction to the shape of a line.

The wave portions 230 are formed to the shape of stripes surrounding each central portion 210 and spaced apart from one another to gradually expand outwardly.

The radial portions 220 and the wave portions 230 are alternately arranged to one another to provide a spider web-like shape.

Of course, the grip reinforcing members 200 may have various patterns with given distances, such as a lattice, a zigzag pattern, and the like.

Further, the portion of the third cover 130 for covering the ring finger is the region where a grip force is weakest when the wearer grips the golf club, and accordingly, the distances of the radial portions 220 and the wave portions 230 are narrower than those of other portions and thus densely formed, thereby desirably strengthening both of the contact force and the grip force.

Like this, the spider web-like grip reinforcing members 200 are formed on the second cover 120 and the third cover 130, respectively, so that the surface contact force can be improved to provide slip prevention and grip force enhancement.

Further, the radial portions 220 and the wave portions 230 are spaced apart from one another, respectively, and accordingly, the functional fabric is exposed from the spaces of the radial portions 220 and the wave portions 230, thereby providing fast water absorption and emission.

Further, each grip reinforcing member 200 may be formed of a plurality of scale members 250 overlapped with one another, not the silicone coated on the body 100.

Figure 3:
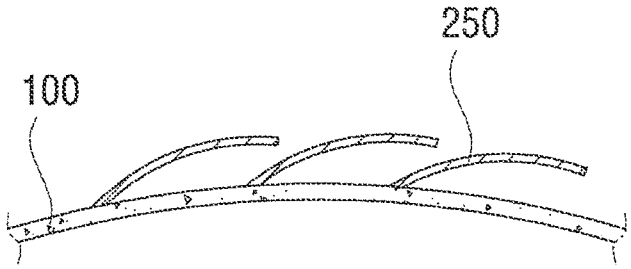
FIG. 3 is a sectional view showing another example of the grip reinforcing member of the leisure glove according to the present invention.

In specific, as shown in FIG. 3, each scale member 250 is made by coating silicone on top of a thin sheet and has one end coupled to the body 100 and the other end separated from the body 100.

Further, each scale member 250 is configured such that the other end of one scale member 250 overlappedly covers one end of the neighboring scale member 250 along the radial portions 220 and the wave portions 230.

If a pushing force is generated from the glove, the scale members 250 stand in the direction in which they push, thereby preventing the glove from pushing.

Figure 4:
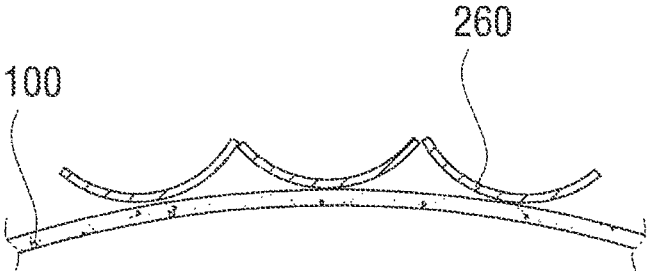
FIG. 4 is a sectional view showing yet another example of the grip reinforcing member of the leisure glove according to the present invention.

In some cases, as shown in FIG. 4, each grip reinforcing member 200 may be formed of a plurality of sucking members 260 whose central portions 210 are concavely formed as suction cups with openings facing away and bottoms facing toward the surface direction of the body 100.

If the golf club is gripped by the wearer's hand, the sucking members 260 are adapted to form vacuum layers between the central portions 210 and the surface of the golf club, thereby ensuring a high contact force with the golf club.

As described above, the leisure glove according to the present invention has the following advantages.

The radial portions formed radially from the central portions and the stripe-shaped wave portions surrounding the central portions are spaced apart from one another, respectively, so that the contact force with the golf club can be strengthened to improve the grip force, while the absorption and emission of sweat are being easily performed.

In addition, the body of the leisure glove according to the present invention is configured to have the second cover for covering the wearer's thumb and the third cover for covering the other fingers of the wearer except the thumb, which are located on both sides of the first cover, so that when the wearer grips the golf club, the interference between the thumb and the other fingers can be reduced to provide easy movements.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A leisure glove comprising:

a body (100) made of a functional fabric for surrounding a wearer's hand; and grip reinforcing members (200) made of silicone and formed on an outer surface of a palm portion of the body (100), wherein the body (100) is formed from a plurality of covers corresponding to different regions of the wearer's hand, the plurality of covers comprising:

a first cover (110) made of the functional fabric adapted to cover at least a front surface of a wrist of the wearer's hand with a wrist cover part having a front wrist side, wherein the first cover includes a first cover extension that extends from the front wrist side to cover a crease between a thumb of the wearer's hand and a back of four fingers including index, middle, ring and little fingers of the wearer's hand, the first cover extension having a thumb edge and a four fingers edge:

a second cover (120) made of the functional fabric connected to the thumb edge of the first cover extension of the first cover (110) to cover a front surface of the thumb of the wearer's hand; and a third cover (130) made of the functional fabric connected to the four fingers edge of the first cover extension of the first cover (110) to cover front surfaces of the four fingers including the index, middle, ring, and little fingers of the wearer's hand, wherein the first cover extension separates the second cover and the third cover connected respectively to the thumb edge and to the index finger edge of the first cover extension, and wherein the second cover includes the grip reinforcing members (200) comprising:

a first central portion (210) formed on a bottom region of the second cover configured to cover a base region of the thumb of the wearer;

radial line portions (220) extending in a plurality of directions away from the first central portion (210); and stripe portions (230) extending in between the radial lines successively away from the first central portion, and wherein the third cover includes the grip reinforcing members (200) comprising:

a second central portion (210) formed on a palm portion of the third cover (130) below a ring finger portion of the third cover;

radial line portions (220) extending in a plurality of directions away from the second central portion (210); and stripe portions (230) extending in between the radial lines successively away from the second central portion.

2. The leisure glove according to claim 1, wherein the radial lines and the stripe portions of each of the grip reinforcing members is comprised of a plurality of scale members that overlap with one another such that one end of each scale member of the plurality of scale members covers a portion of a neighboring scale member of the plurality of scale members.

3. The leisure glove according to claim 1, wherein at least one of the central portions, radial line portions and stripe portions of the grip reinforcing members (200) is formed of a plurality of sucking members (260) each concavely formed as a suction cup opening facing away from and a suction cup bottom facing toward the body (100).

4. The leisure glove according to claim 1, wherein at least one of the first central portion (210) and the second central portion (210) is shaped as a spider.

5. The leisure glove according to claim 4, wherein the radial line portions and the stripe portions of the at least one of the first central portion and the second central portion are alternately arranged to one another to provide a spider web-like shape with the radial lines converging on the central portion.

6. The leisure glove according to claim 1, wherein the radial line portions and the stripe portions of the at least one of the first central portion and the second central portion are alternately arranged to one another to provide a spider web-like shape with the radial lines converging on the central portion.

7. The leisure glove according to claim 1, wherein the first cover extension extending from the front wrist side extends toward the middle finger to the third cover and then turns at an obtuse angle to cover the crease between the thumb and the four fingers of the wearer's hand.

* * * * *